United States Patent [19]

Holtzberg

[11] 4,369,423

[45] Jan. 18, 1983

[54] COMPOSITE AUTOMOBILE IGNITION CABLE

[76] Inventor: Matthew W. Holtzberg, 342 Plaza Rd., N., Fairlawn, N.J. 07410

[21] Appl. No.: 179,681

[22] Filed: Aug. 20, 1980

[51] Int. Cl.[3] ..... H01C 7/00

[52] U.S. Cl. ..... 338/66; 338/214

[58] Field of Search ..... 338/66, 214; 174/126 R, 174/128 R; 423/447.1, 447.2

[56] References Cited

U.S. PATENT DOCUMENTS 3,284,751 11/1966 Barker et al. ..... 338/214 X
3,680,027 7/1972 Vitale ..... 338/66 X

FOREIGN PATENT DOCUMENTS 48-25589 7/1973 Japan ..... 338/214
7304398 10/1973 Netherlands ..... 423/447.1

*Primary Examiner*—C. L. Albritton
*Attorney, Agent, or Firm*—Weingram & Klauber

[57] ABSTRACT

A composite electrically conductive cable assembly for use as an ignition cable or the like. The assembly comprises an electrically conductive core comprising a plurality of mechanically and electrically continuous graphite filaments, and an electrically insulating elastomeric jacket which surrounds and envelopes the said filaments. The filaments preferably comprise graphitized polyacrylonitrile.

8 Claims, 1 Drawing Figure

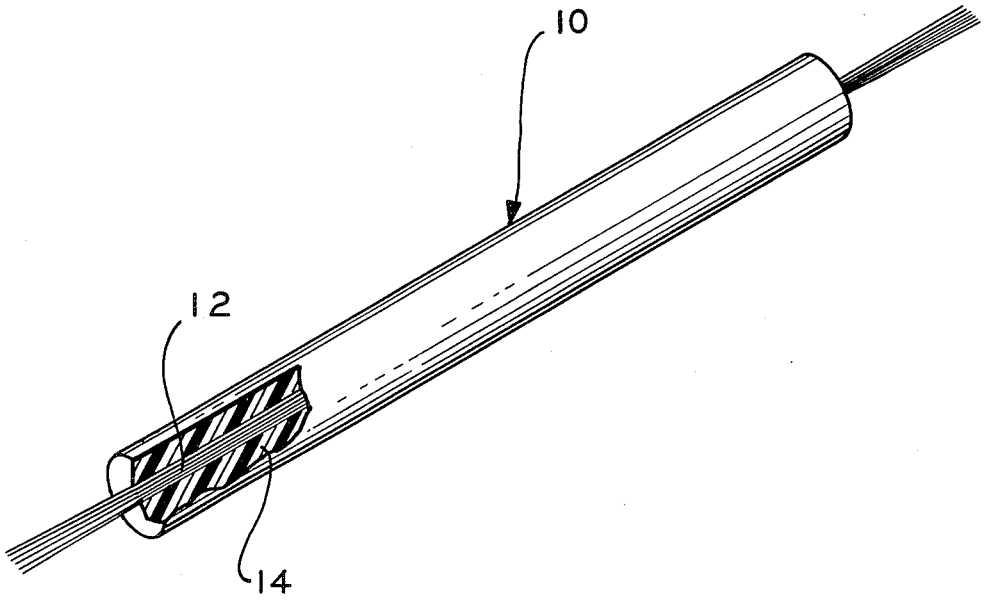
10
12
14

COMPOSITE AUTOMOBILE IGNITION CABLE

BACKGROUND OF INVENTION

This invention relates generally to electrical conductors, and more specifically relates to an electrically conductive cable assembly, which is especially adaptable to use as an ignition cable for internal combustion engines or the like.

The ignition cables which are conventionally utilized with internal combustion engines, most commonly comprise a central electrically conductive core which is surrounded by an elastomeric electrical insulator such as a natural or synthetic rubber or other synthetic elastomer having good insulating properties and relatively good resistance to heat and the adverse chemical environment present in the vicinity of the said engine.

The central conductive core of the ignition cable has most commonly comprised a metallic conductor, which often takes the form of stranded copper or so forth. It has, however, also been known for many years to utilize non-metallic current-carrying conductors enclosed in insulating jackets or the like. It has further, long been recognized that certain types of such non-metallic conductors display distributed resistance characteristics, and in consequence, serve to reduce RF and other high frequency electrical disturbances which often emanate from the simple metallic conductor type of cable. Such electrical emanations can present a most serious interference problem with regard to operation of radio and television sets, or with respect to operation of other communication equipment.

Over the years, various types of non-metallic current carrying cores have been proposed. British Pat. No. 464,278, for example, which was published in 1937, discloses an ignition cable comprising an outer cover of rubber or other flexible insulation material, and a flexible core of non-conducting fibrous material which has been coated or impregnated with a conductive medium in a finely divided condition. For the fibrous core, a stranded silk, cotton or linen thread may be employed. This thread can be impregnated with colloidal graphite. A similar concept is disclosed in British Pat. No. 547,481.

More recently, high frequency noise prevention cables for ignition applications have been proposed which employ non-metallic filaments in the conducting core of the cable. Such filament can, for example, be formed from glass, with the glass filaments being provided with a film of conductive non-metallic particles such as of carbon, or graphite, which is dispersed in a binding agent. An assembly of this type is discussed in U.S. Pat. No. 3,683,309.

It is also known, as for example is disclosed in U.S. Pat. No. 3,870,987, for the central conductive core in an automobile ignition cable to comprise a plurality of graphite-impregnated fiberglass filaments.

While many of these structures have indeed represented useful and practical improvements in the pertinent art, the said cable constructions have suffered from a variety of problems. Among other things, the non-metallic conductive core members as above discussed, have in many instances been lacking in flexibility, and have exhibited poor strength. Further, the electrical properties of these non-metallic materials have in many instances been erratic. This is often due to the fact that in most instances, electrical conduction is actually effected via dispersed discrete particles. The conductivity of the said materials further, is in many instances too low to be fully adequate for modern automobile ignition systems; and in addition, many of the prior art cable constructions do not stand up to the prolonged high temperature and corrosive environments existing in the vicinity of modern engines.

In accordance with the foregoing, it may be regarded as an object of the present invention, to provide an automobile ignition cable structure or assembly, which has excellent and uniform electrical conductivity characteristics, which displays high tensile strength properties, which may be repeatedly and readily flexed without producing physical or electrical damage to the said cable, and which is highly resistive to damage by high temperatures or corrosive fumes.

It is a further object of the present invention, to provide an automobile ignition cable assembly as aforementioned, which can be utilized in modern engines and with high voltage inputs, and yet generate relatively minute quantities of RF signals, thereby minimizing interference with radio and television receivers and/or with other communications equipment.

SUMMARY OF INVENTION

Now in accordance with the present invention, the foregoing objects, and others as will become apparent in the course of the ensuing specification, are achieved in a composite, electrically conductive cable assembly, which is especially intended for use as an ignition cable or the like in an internal combustion engine.

The conductive cable assembly of the invention comprises an electrically conductive core which includes a plurality of mechanically and electrically continuous graphite filaments, and an electrically insulating jacket which surrounds and envelopes the plurality of said filaments. The filaments comprise graphitized organic precursor fibers, and preferably comprise graphitized polyacrylonitrile (PAN). Other precursor materials for the said filaments, include rayon and pitch. The bundle of graphite filaments comprising the conductive core is further, preferably precoated with a thin layer of a polymeric resin, such as an epoxy, acrylic or polysulfone, which resin is applied during the manufacturing process incident to production of the cable assembly.

The surrounding non-conductive jacket or sleeve preferably comprises an elastomeric silicone, with the bundle of filaments and elastomeric silicone jacket being co-extruded to thereby provide a structure in which the central filaments are embedded in the surrounding matrix defined by the silicone jacket. The plurality of filaments are preferably twisted lengthwise among themselves prior to the co-extrusion process. This twisting, in conjunction with the pre-coating with the resin, serves to increase the rigidity (and thereby the handleability) of the central filament bundle and also appears to improve the electrical conductivity of the bundle. The number of filaments present in the said bundle is usually of the order of thousands; in typical ignition cable application, from 3,000 to 6,000 such filaments will representatively be provided—however, the specific number of filaments will be selected in accordance with the requirement for the particular cable assembly. Individual filaments have a cross section of from about 10 to 70 square microns.

BRIEF DESCRIPTION OF DRAWINGS

The invention is diagrammatically illustrated by way of example, in the drawings appended hereto, in which:

The FIGURE is a perspective view, partially diagrammatic in nature, illustrating a composite automobile ignition cable in accordance with the present invention.

DESCRIPTION OF PREFERRED EMBODIMENT

In the perspective view set forth in the FIGURE, there appears a composite electrically conductive ignition cable assembly 10 in accordance with the invention. A length of the said assembly 10 is illustrated, which assembly is seen to comprise generally a central electrically conductive core 12, which is surrounded by an electrically insulating jacket 14. Jacket 14, preferably comprises an elastomeric silicone, which is co-extruded with the central conductor 12. Jacket 14 may also however, comprise other electrically insulating elastomeric materials, such as a butadiene styrene rubber, a chlorosulfanated polyethelene or so forth.

The insulating jacket 14 has a relatively much larger diameter than central conductor 12, typically being of the order of 7 or 8 mm. The total width of the said jacket is such as to give the assembly 10 approximate dimensions as are relatively standard in ignition cable applications. The relatively large mass of insulation provided relative to the conductor 12 affords excellent electrical insulating properties with respect to the high potentials which are carried by conductor 12; and the relatively thick jacket 14 also provides excellent protection against the corrosive fumes and high temperatures present in the engine environment in which the present cable 10 is commonly employed.

In accordance with the principal aspect of the present invention, the electrically conductive core 12 comprises a bundle including a very large number of graphitized organic precursor fiber filaments. Although organic precursor materials such as rayon or pitch may be used as source materials for the graphite filaments, the filaments preferably comprise graphitized polyacrylonitrile (PAN).

The graphite filaments comprising conductive core 12, are not per se, of the present invention; although of course, in combination they are an essential aspect of same. The said filaments are produced by controlled pyrolysis of organic precursor fibers, and preferably from pyrolysis of PAN yarn or fibers.

In a typical such process the PAN yarn is initially heated in an oxidizing atmosphere at temperatures of the order of 200°-250° C., subsequently in a nonoxidizing atmosphere to 1000° C. or above to carbonize the fibers comprising the yarn, and is thereupon subjected to further heating to temperatures of the order of 1,000° to 2,000° C., to graphitize the said materials and produce higher modulus fibers. The graphite filaments which result from the aforementioned process, are extremely fine, individual filaments generally having a cross-section of from about 10 to about 70 square microns. In typical embodiments of the present invention, of the order of 3000 to 6000 such filaments will often be present in side-by-side extending fashion in the bundle of filaments which define conductive core 12; larger or smaller numbers of filaments may, however, be present, depending upon the electrical and other requirements for the cable assembly 10. For example, filament tows including up to 40,000 filaments are presently available; and these higher (or lower) numbers of filaments can in some applications prove desirable.

The said graphite filaments display excellent electrical conductivity; this is partially a consequence of their mode of manufacture, which produces highly organized crystal structures. They accordingly also possess outstanding strength characteristics, which is highly significant for present purposes, in enabling the composite assembly 10 to withstand sustained use, and especially repeated flexing during installation or use.

The graphite filament bundles which comprise conductor 12, are commercial products which are available from several sources, as for example under the trademark "Fortafil" from Great Lakes Carbon Corporation, New York, New York; under the trademark "Grafil" from Courtaulds, Carbon Fibers Unit, Coventry, England; and under the trademark "Thornel" from Union Carbide Corporation. These materials are provided in indeterminate "tows", from the aforementioned suppliers. Heretofore, the said commercial products have been utilized principally for purposes of reinforcing composite plastic materials, i.e., the said materials have been utilized primarily for their contribution to mechanical strength of the materials with which they are integrated.

In the preferred method of manufacturing the present assembly 10, the bundle of filaments, as same is provided from the commercial manufacturer, is preferably subjected to an initial twisting, and then run through a polymeric resin bath; and only thereupon subjected to co-extrusion with the elastomeric silicone or other material intended to serve as insulating jacket about the conductive core 12. Both the introduction of a twist into the filament tow and the application of resin, serve to increase the coherence and handleability of the bundle of filaments, which otherwise tend to feather out during fabrication because of their very fine nature. This also tends to provide increased coherence and rigidity in the conductive core upon the final product being yielded as in the FIGURE.

In a typical product produced in accordance with the invention, an ignition cable assembly 10 having an overall diameter of 8 mm and including a central conductive core composed of 3000 filaments of the aforementioned "Grafil" fibers was produced. The said product had a conductivity of 65 ohms/linear foot at room temperature, and when utilized with a 20,000 volt conventional automobile ignition system, was found to produce virtually no detectable RF interference. Further, the product continued to generate virtually no RF interference as the potential was increased to levels as high as 100,000 volts; and neither was there any apparent tendency to dielectric breakdown, even at the indicated very high potentials. The material was further, found on repeated flexure to indefinitely retain the said desirable electrical properties, and to retain complete mechanical coherence. The cable assembly, further, was found to display decreasing resistance with rise in temperature. This indeed is a most important and highly desirable characteristic of the present invention.

The above product of the invention can be compared with prior art products in order to render clear the advantages of the new product. Thus, a typical ignition cable utilizing a copper conductive core or carbon deposition on a fiberglass core, exhibits from about 3,000 to 10,000 ohms per linear foot. The copper core structure exhibits very high RF interference. The fiberglass core structure, while exhibiting little RF interference at potentials below 20,000 volts, generates increasing RF interference above such potentials, and otherwise begins to exhibit dielectric breakdown. Further in such prior art structure, the resistance is found to undesirably increase as a function of temperature.

While the present invention has been particularly set forth in terms of specific embodiments thereof, it will be understood in view of the present teaching, that numerous variations upon the invention are now enabled to those skilled in the art, which variations yet reside within the scope of the present invention. Accordingly, the invention is to be broadly construed, and limited only by the scope and spirit of the claims now appended hereto.

I claim:

1. A composite electrically conductive cable assembly for use as an ignition cable or the like, comprising in combination:

an electrically conductive core comprising a plurality of graphitized polyacrylonitrile filaments; and an electrically insulating elastomeric jacket surrounding and enveloping said plurality of filaments.

2. A cable assembly in accordance with claim 1, wherein said filaments are mechanically and electrically continuous for the length of said cable.

3. An assembly in accordance with claim 1, wherein the bundle of said filaments defining said conductive core is coated with a thin resin layer, and the plurality of filaments are twisted lengthwise among themselves to increase the rigidity and coherence of said bundle.

4. An assembly in accordance with claim 2, wherein each individual filament has a cross-section of from 10–70 square microns.

5. An assembly in accordance with claim 4, wherein said conductive core includes from 3,000 to 6,000 of said filaments.

6. An assembly in accordance with claim 2, wherein said jacket comprises an elastomeric silicone, said plurality of filaments and said silicone being co-extruded to provide a structure in which said filaments are embedded in the surrounding matrix defined by said silicone.

7. An electrically conductive ignition cable comprising a bundle of graphitized polyacrylonitrile filaments extending commonly and longitudinally within a surrounding insulating elastomeric matrix, said matrix and filaments being co-extruded to provide a coherent structure.

8. A cable in accordance with claim 7, including from about 3,000 to 6,000 of said filaments, where each filament has a cross-section in the range of from 10–70 square microns.

* * * * *